US008673117B2

(12) United States Patent
Rosencrance et al.

(10) Patent No.: US 8,673,117 B2
(45) Date of Patent: Mar. 18, 2014

(54) DEGRADING AGENT COMPOSITIONS FOR TEMPORARY WET STRENGTH SYSTEMS IN TISSUE PRODUCTS

(75) Inventors: Scott Rosencrance, Douglasville, GA (US); Yuping Luo, Duluth, GA (US); Vladimir Grigoriev, Atlanta, GA (US)

(73) Assignee: Kemira Oyj (FI)

( * ) Notice: Subject to any disclaimer, the term of this patent is extended or adjusted under 35 U.S.C. 154(b) by 345 days.

(21) Appl. No.: 12/894,603

(22) Filed: Sep. 30, 2010

(65) Prior Publication Data

US 2012/0080157 A1 Apr. 5, 2012

(51) Int. Cl.

| | |
|---|---|
| ***D21H 17/13*** | (2006.01) |
| ***D21H 17/14*** | (2006.01) |
| ***D21H 17/28*** | (2006.01) |
| ***D21H 17/45*** | (2006.01) |
| ***D21H 17/60*** | (2006.01) |
| ***D21H 17/64*** | (2006.01) |
| ***D21H 17/65*** | (2006.01) |
| ***D21H 17/66*** | (2006.01) |
| ***D21H 21/20*** | (2006.01) |
| ***D21H 23/04*** | (2006.01) |
| ***D21H 23/24*** | (2006.01) |

(52) U.S. Cl.

USPC ..... 162/166; 162/164.1; 162/164.4; 162/168.1; 162/168.3; 162/158; 162/181.2; 162/181.3; 162/181.4; 162/181.5; 162/184; 162/185; 106/206.1; 106/287.13; 106/464; 106/467

(58) Field of Classification Search

USPC ..... 162/135, 136, 158, 164.6, 166, 162/168.1–168.3, 181.1–181.5, 183–185, 162/164.1, 164.4; 106/206.1, 287.13, 429, 106/464, 471, 475, 477

See application file for complete search history.

(56) References Cited

U.S. PATENT DOCUMENTS

| | | | | |
|---|---|---|---|---|
| 3,556,932 | A * | 1/1971 | Coscia et al. | 162/166 |
| 4,981,557 | A | 1/1991 | Bjorkquist | |
| 5,401,810 | A | 3/1995 | Jansma et al. | |
| 5,690,790 | A | 11/1997 | Headlam et al. | |
| 5,846,380 | A * | 12/1998 | Van Phan et al. | 162/111 |
| 6,126,784 | A * | 10/2000 | Ficke et al. | 162/184 |
| 6,420,013 | B1 * | 7/2002 | Vinson et al. | 428/154 |
| 6,548,427 | B1 | 4/2003 | Shannon et al. | |
| 6,855,229 | B2 * | 2/2005 | McKay et al. | 162/179 |
| 7,258,763 | B2 | 8/2007 | Barcus et al. | |
| 2004/0082668 | A1 * | 4/2004 | Vinson | 516/38 |
| 2004/0118540 | A1 * | 6/2004 | Garnier et al. | 162/164.1 |
| 2006/0110432 | A1 * | 5/2006 | Luu et al. | 424/443 |
| 2006/0180288 | A1 | 8/2006 | Barcus et al. | |
| 2007/0251657 | A1 | 11/2007 | Barcus et al. | |
| 2008/0017339 | A1 * | 1/2008 | Zhang et al. | 162/168.3 |
| 2009/0229776 | A1 * | 9/2009 | Zhang et al. | 162/164.6 |

FOREIGN PATENT DOCUMENTS

| | | | |
|---|---|---|---|
| WO | 2006044116 | A2 | 4/2006 |
| WO | 2006044117 | | 4/2006 |
| WO | 2006044117 | A2 | 4/2006 |
| WO | 2006044134 | A2 | 4/2006 |

OTHER PUBLICATIONS

The International Preliminary Report on Patentability dated Apr. 11, 2013.

* cited by examiner

*Primary Examiner* — Dennis Cordray
(74) *Attorney, Agent, or Firm* — Thomas Horstemeyer, LLP

(57) ABSTRACT

A degrading agent composition for use in manufacturing a tissue product generally includes a degrading agent, a degradation inhibiting carrier, and a non-ionic surfactant. The non-ionic surfactant stabilizes the viscosity of the composition as a function of time. The degrading agent composition can be used in combination with a temporary wet strength agent to produce a tissue product exhibiting high initial wet tensile strength and desirable decay properties. Processes for forming the tissue product and pumpable fluids containing the degrading agent composition are also disclosed.

14 Claims, No Drawings

DEGRADING AGENT COMPOSITIONS FOR TEMPORARY WET STRENGTH SYSTEMS IN TISSUE PRODUCTS

BACKGROUND OF THE INVENTION

The tissue industry has a long-felt need for very high decaying temporary wet strength system. Poor decay translates into the clogging of pipes and septic systems. While many consumers desire wet strength in their tissue, there are consumers who do not use tissue that exhibit poor decay properties. A tissue with high initial wet strength and outstanding decay properties would have a very significant benefit for consumers.

Temporary wet strength systems are available that provide both high initial wet strength and outstanding decay. These systems generally include a wet strength agent and a degrading agent composition that work together to provide the desired initial wet strength and decay properties. However, these systems present significant challenges to the manufacturer during application of the degrading agent composition to the tissue product. One of the problems related to the degrading agent concerns stability of the composition as a function of time. Oftentimes, the degrading agent composition is formulated and stored in large quantities well ahead of its actual application. It has been discovered that the viscosity of these prior art compositions significantly increases as a function of time, which renders these formulations difficult, if not impossible, to uniformly apply using existing equipment and pumps. In some instances, the increase in viscosity is to an extent that the composition is no longer a pumpable fluid.

Employing a degrading agent composition in the temporary wet strength system that is stable and easily applied during manufacturing to produce tissue products that exhibit both high decay properties and high initial wet strength would provide numerous benefits to both consumers and papermakers.

SUMMARY OF THE INVENTION

The present invention relates to a degrading agent composition and its use in forming tissue product having both high initial wet strength and desirable decay properties. In one embodiment, the process for forming a tissue product comprises applying a temporary wet strength agent to a pulp slurry, wherein the a temporary wet strength agent is capable of forming hemi-acetal bonds with the fibers of the pulp slurry in an amount effective to prevent immediate degradation of the tissue product upon contact with water; applying a degrading agent composition to the pulp slurry or to the wet fibrous sheet or to the dry fibrous sheet comprising a degrading agent, a degrading inhibiting carrier comprising a lotion or a cream, and a non-ionic surfactant in an amount effective to reduce the viscosity to less than 3,000 cPs at 25° C. after 24 hours of storage; and forming a tissue product from the pulp slurry.

A pumpable fluid composition for degrading a temporary wet strength agent disposed within a fibrous web of a tissue product comprises a degrading agent selected from the group consisting of alkaline agents, oxidizing agents, nucleophilic agents, and combinations thereof; a degradation inhibiting carrier component; and a non-ionic surfactant.

A degrading agent composition for fabricating a tissue product, the degrading agent composition comprises a degrading agent selected from the group consisting of alkaline agents, oxidizing agents, nucleophilic agents, and combinations thereof; a degrading inhibiting carrier comprising a lotion or a cream; and a non-ionic surfactant in an amount effective to stabilize viscosity of the composition to less than 3000 cPs at 25° C. after about 24 hours.

These and other features, aspects, and advantages of the present invention will become better understood with reference to the following description and appended claims.

DETAILED DESCRIPTION

The present invention relates to a tissue product that comprises a tissue fibrous web incorporated throughout the tissue product; a temporary wet strength agent capable of forming hemi-acetal bonds with the fibers of the web to prevent immediate degradation of the web when the tissue product contacts water; and a degrading agent composition. The degrading agent composition is generally a lotion or cream including a degrading agent and a non-ionic surfactant, which imparts stability to the degrading agent composition such that the viscosity is stabilized as a function of time. As such, the degrading agent composition overcomes the problems noted in the art and can be easily applied to the pulp slurry or to the tissue fibrous web during manufacturing to produce a tissue product that exhibits both high initial wet strength and high decay properties.

The wet strength agent and the degrading agent are located throughout the fibrous web and are present in an amount sufficient to make the fibrous web exhibit (i) an immediate wet tensile strength of at least 90% of the wet strength as compared to a tissue product that does not contain the temporary wet strength agent and the degrading agent and (ii) a wet soak decay that is at least a ten point improvement as compared to a tissue product that does not contain the degrading agent.

The invention is based on the discovery that by formulating the degrading agent composition with the non-ionic surfactant it is now possible to manufacture a tissue product having a highly useful combination of properties, namely (i) an immediate wet tensile strength of at least 90% of the wet strength as compared to a web that does not contain the wet strength agent and the degrading agent and (ii) a wet soak decay that is at least a ten point improvement as compared to a tissue fibrous web that does not contain the degrading agent. The phrase "a ten point improvement," refers to the tensile strength difference between the initial wet tensile strength and a thirty minute wet soak tensile strength as a percentage of the initial wet tensile strength, which is at least ten full points or greater using the invented technology, e.g., 80% vs. 70%. The phrase "the water drop test" refers to the time, measured in seconds, for a 5 microliter drop of water to absorb into a sheet of paper.

Other than in the operating examples or where otherwise indicated, all numbers or expressions referring to quantities of ingredients, reaction conditions, and the like, used in the specification and claims are to be understood as modified in all instances by the term "about." Various numerical ranges are disclosed in this patent application. Because these ranges are continuous, they include every value between the minimum and maximum values. Unless expressly indicated otherwise, the various numerical ranges specified in this application are approximations.

As discussed above, suitable temporary wet strength agents are capable of forming hemi-acetal bonds with the fibers of the web to provide a relatively high initial wet strength in the fibrous sheet and to prevent immediate degradation of the web when the tissue product contacts water. Exemplary temporary wet strength agents include, without limitation, dialdehyde starches, glyoxylated polyacrylamides, and combinations thereof. In one embodiment, the temporary wet strength agent is a glyoxylated polyacrylamide having a backbone that is less than 50,000 daltons prior to glyoxylation.

The amount of the temporary wet strength agent can vary depending on the application. In one embodiment, the temporary wet strength agent is in an amount that is at least 0.05 wt %, based on the weight of the dry fiber. In another embodiment, the temporary wet strength agent is in an amount that is at least 0.1 wt %, based on the weight of the dry fiber. In still another embodiment, the temporary wet strength agent is present in an amount ranging from 0.05 to 2.0 wt %, based on the weight of the dry fiber.

The degrading agent composition generally includes a degrading agent, a degradation inhibiting carrier, and a non-ionic surfactant. The degrading agent composition including the non-ionic surfactant is a stable pumpable fluid and has a fluid viscosity of less than 3000 centipoise (cPs) as measured at 25° C. In other embodiments, the viscosity of the degrading agent composition is less than 2000 cPs as measured at 25° C., and in still other embodiments, the viscosity is less than 1000 cPs as measured at 25° C. The non-ionic surfactant minimizes any viscosity increases that occur after storage for prolonged periods of time in the absence of the non-ionic surfactant.

Upon contact of the tissue product with water, the degrading agent functions by degrading the temporary wet strength agent-fiber bonds in the fibrous sheet. Suitable degrading agents are generally selected from the group of alkaline agents, oxidizing agents, nucleophilic agents, and combinations thereof. Examples of suitable degrading agents include, and are not limited to, magnesium hydroxide ($Mg(OH)_2$), calcium hydroxide ($Ca(OH)_2$), magnesium bisulfite ($Mg(HSO_3)_2$), magnesium oxide (MgO), zinc oxide (ZnO), sodium sulfite ($Na_2SO_3$), magnesium carbonate-magnesium hydroxide ($(MgCO_3)_4.Mg(OH)_2$), sodium oxide-aluminum oxide ($Na_2O.Al_2O_3$), hydrogen peroxide ($H_2O_2$), sodium carbonate ($Na_2CO_3$), sodium bicarbonate ($NaHCO_3$), sodium benzoate, calcium carbonate ($CaCO_3$), calcium bicarbonate ($Ca(HCO_3)_2$), sodium acetate, and combinations thereof. In one embodiment, the alkaline reagent component excludes sodium acetate, sodium benzoate, sodium carbonate, sodium bicarbonate, calcium carbonate, calcium bicarbonate, and combinations thereof.

In one embodiment, the amount of degrading agent in the composition is between 1% and 50% by weight; in other embodiments, the amount is between 3% and 40%; and in still other embodiments, the amount of degrading agent is between 5% and 30%.

The degradation inhibiting carrier can include lotions or creams. As used herein, the term lotion or cream generally refers to a liquid preparation for cosmetic or medicinal use, which is typically in the form of a liquid suspension, solution, or emulsion. By way of example, a suitable lotion can include mixtures containing materials selected from the following: water, mineral oil, petrolatum, sorbitol, stearic acid, lanolin, lanolin alcohol, cetyl alcohol, glyceryl stearate, PEG-100 stearate, triethanolamine, dimethicone, propylene glycol, microcrystalline wax, triethyl citrate, PPG-3 myristyl ether, disodium EDTA, methylparaben, ethylparaben, propylparaben, fragrance, xanthan gum, butylparaben, methyldibromo glutaronitrile. Lotions containing the following materials can also be used: a mixture of water, glycerin, sodium myristoyl sarcosina, PEG-120 methyl glucose dioleate, sodium lauroamphoacetate, disodium lauroamphoacetate, glycol distearate, PEG-150 pentaerithritol tetra stearate, sodium trideceth-sulfate, polyquaternium-10, sodium laureth sulfate, phenoxyethanol, cocamide mea, citric acid, DADM hydantoin, disodium EDTA, laureth-10, fragrance. In one embodiment, a cream containing materials selected from the following can be used: a mixture of water, sodium $C_{14-16}$ olefin sulfonate, cocamidopropyl betaine, cetyl alcohol, stearyl alcohol, di-$C_{12-15}$ alkyl fumarate, coco-glucoside, coconut alcohol, sodium methyl cocoyl taurate, DEA-cetyl phosphate, matriciaria (*chamomilla recutita*) flower extract, *aloe barbadensis* leaf extract, chamonile (*anthemis nobiiis*) flower extract, hydroxypropyl methylcellulose, potato (*sodium tuberosum*) starch, propylene glycol, fragrance. In another embodiment, a cream containing the following materials can be used: a mixture of water, sodium cocoyl isethionate, propylene glycol, stearic acid, cetearyl alcohol, cocoamidopropyl betaine, hydroxypropyl methylcellulose, sodium lauroyl sarcosinate, salicylic acid, menthol, fragrance, magnesium aluminum silicate, disodium ethylendiaminetetraaceetate (EDTA), methylparaben, propylparaben, DADM hydantonin, titanium dioxide (CI 77891). Alternatively, the following materials may also be suitable: sodium dioctyl sulfosuccinate in petroleum distillate; polyoxyethylene(10) oleyl ether; and polyoxyethylene(2) cetyl ether. Examples of commercially available materials can be selected from the group of Aerosol OT, Variquat K1215, Suave Cream, Neutragena Cream, Olay lotion, tissue softener, Brij 97, Brij 52, solid wax coatings, other such protective hydrophobic liquid vehicles, and combinations thereof.

The degradation inhibiting carrier prevents the degrading agent from lowering the initial wet tensile strength such that the degradation inhibiting carrier delays the action of the degrading agent on the temporary wet strength agent. The degradation inhibiting carrier may be described as a hydrophobic carrier, e.g., a protective hydrophobic liquid vehicle, that allows the degrading agent to lower the temporary wet soak tensile strength, thereby improving the decay properties.

In one embodiment, the degradation inhibiting carrier is at a weight ratio to the degrading agent of about 99:1 to about 10:90; in another embodiment about 90:10 to about 30:70 and in still another embodiment, about 80:20 to about 50:50.

The non-ionic surfactant has been found to impart stability to the degrading agent composition as a function of time. In most embodiments, the non-ionic surfactant is less than 80% by weight of the degrading agent composition. In other embodiments, the non-ionic surfactant is less than 50% by weight of the degrading agent composition, and in still other embodiments, the non-ionic surfactant is less than 10% by weight of the degrading agent composition. Increases in viscosity as a function of time are minimized, thereby maintaining the composition as a pumpable fluid, which can be stored for prolonged periods of time, if desired. Non-limiting examples of suitable non-ionic surfactants include ether types, ether ester types, ester types, nitrogen-containing types, polyhydric alcohols, amino alcohols, polyethylene glycols, and mixtures thereof.

Specific non-limiting examples of suitable non-ionic surfactants include polyoxyethylene adducts such as alkylpolyoxyethylene ethers, alkylpolyoxyethylenes, polyoxypropylene ethers, fatty acid polyoxyethylene esters, fatty acid polyoxyethylene sorbitan esters, fatty acid polyoxyethylene sorbitol esters, polyoxyethylene castor oils, and alkylpolyoxyethylene amines, and amides; polyhydric alcohols and alkylol amides such as fatty acid sorbitan esters, fatty acid polyglycerin esters and fatty acid sucrose esters; silicone-base surfactants such as polyethers-modified, alkylaralkylpolyether-modified, epoxypolyether-modified, alcohol-modified, fluorine-modified, amino-modified, mercapto-modified, epoxy-modified, or allyl-modified silicone-base surfactants; and fluorine-base surfactants such as perfluoroalkylethylene oxide adduct. The above-exemplified nonionic surfactants can be used in combination.

In one embodiment, the non-ionic surfactants of the invention are polyoxyethylene adducts such as alkylpolyoxyethylene ethers, alkylpolyoxyethylenes, polyoxypropylene ethers, fatty acid polyoxyethylene esters, fatty acid polyoxyethylene sorbitan esters, fatty acid polyoxyethylene sorbitol esters, polyoxyethylene castor oils, and alkylpolyoxyethylene amines, and amides.

The degrading agent composition can be made by any suitable method. The composition containing the degrading agent is specifically designed to be used to make tissue products having a combination of useful immediate wet tensile strength and wet soak decay properties. Generally, the composition containing the degrading agent component includes a liquid degradation inhibiting carrier; a degrading agent component selected from the group consisting of oxidizing agents, alkaline agents, nucleophilic agents, and combinations thereof; and a non-ionic surfactant. In one embodiment, the degrading agent component is liquid. In another embodiment, the degrading agent is a solid moiety suspended in liquid particles. As such, the composition containing the degrading agent includes a carrier including a suspended component selected from the group consisting of alkaline agents, oxidizing agents, nucleophilic agents, and combinations thereof, a hydrophobic carrier that surrounds at least a portion of the suspended component, and a non-ionic surfactant. The approaches for making the degrading agent composition include, but are not limited to, formation of a slurry, a solution, or any other pumpable fluid form. For instance, materials such as $Mg(OH)_2$, $Ca(OH)_2$, $Mg(HSO_3)_2$, $MgO_2$, ZnO, $Na_2SO_3$, $(MgCO_3)_4.Mg(OH)_2$, $Na_2O.Al_2O_3$, $H_2O_2$, or combinations thereof can be suspended, dissolved, or emulsified in lotions, Aerosol OT, Variquat K1215, Suave Cream, Neutragena Cream, Olay lotion, tissue softener, Brij 97, Brij 52, or combinations thereof. The temperatures at which a composition of the invention is made or used varies with application.

The paper products that are treated with the temporary wet strength agent and the degrading agent composition of the invention generally includes any pulp slurry, which when used in accordance to the invention, produces tissue products that exhibit improved initial wet tensile and decay properties. Suitable fibers provide sufficient sheet integrity to make tissue products suitable for their ordinary use. Papermaking fibers for making the tissue product webs of this invention, for instance, can include any natural or synthetic fibers suitable for the end use products listed above including, but not limited to: nonwood fibers, such as abaca, sabai grass, milkweed floss fibers, pineapple leaf fibers; softwood fibers, such as northern and southern softwood kraft fibers; hardwood fibers, such as eucalyptus, maple, birch, aspen, or the like. In addition, furnishes including recycled fibers may also be utilized. In making the tissue products, the fibers are formed into a pulp furnish by known pulp stock formation processes.

The tissue pulp slurry does not necessarily contain an appreciable amount of permanent wet strength agent. In one embodiment, the pulp slurry contains a permanent wet strength resin in an amount that is less than 250 ppm. In another embodiment, the pulp slurry contains a permanent wet strength resin in an amount that is less than 100 ppm. In another embodiment, the pulp slurry does not contain any permanent wet strength resin.

In use, the invention provides a highly effective method for making tissue product having a combination of highly useful properties as a result of the ability to deliver the invention in a carefully specified manner that is the result of the pumpable fluid properties of the substance. In one embodiment, the temporary wet strength agent is added to an aqueous cellulosic suspension to treat the cellulosic fibers contained therein as previously described, e.g, the temporary wet strength agent can be added to the pulp slurry at or before the headbox. In some embodiments, the addition of the temporary wet strength agent is in combination with the degrading agent composition or with other chemicals generally known in the art for use in the production of paper including, but not limited to, sizing agents, softeners, retention aids, dewatering agents, dry strength agents, charge control agents, fillers, and the like.

In other embodiments, the wet strength agent is added to the pulp slurry as described above and the degrading agent composition is added to the wet sheet and/or to the dry sheet.

As noted above, the temporary wet strength agent and the degrading agent composition can be added to the wet end of a papermaking process such that the degrading agent is retained in the final sheet. The order of addition of the temporary wet strength agent and the degradation composition is not important. As such, the invention is useful in a process for forming the tissue product from a tissue fibrous web, such that the invention provides an improvement that involves the addition to the wet-end of the tissue product forming process of a degrading agent composition containing the degrading agent selected from the group consisting of alkaline agents, oxidizing agents, nucleophilic agents, and combinations thereof, and the non-ionic surfactant.

By way of example, a suitable method may include adding to a tissue pulp slurry or a wet fibrous sheet or a dry fibrous sheet compositions or any combination thereof comprising, in any order, (1) a temporary wet strength agent component capable of forming hemi-acetal bonds with the fibers of a tissue web to provide initial wet strength and subsequent rapid degradation of the initial wet strength when the tissue web contacts water, the temporary wet strength agent being present in an amount ranging from 0.05 to 2.0 wt %, based on the weight of the dry fiber; and (2) a degrading agent composition containing a degrading agent selected from the group consisting of alkaline agents, oxidizing agents, nucleophilic agents, and combinations thereof, and a non-ionic surfactant, thereby making a tissue paper product that has a combination of highly useful properties.

When processed in this manner, the degrading agent composition is easily pumped and integrated into the pulp slurry such that the degrading agent is located throughout the fibrous web and is present throughout the tissue product in an amount that is sufficient to make the fibrous web exhibit (i) an immediate wet tensile strength of at least 90% of the wet strength as compared to a web that does not contain a degrading agent and (ii) a wet soak decay that is at least a ten point improvement as compared to a tissue fibrous web that does not contain a degrading agent. The improved decay properties provided by the system means that the risk of clogging of pipes and septic systems is substantially reduced. While many consumers desire wet strength in their tissue, there are consumers who do not use tissue with a temporary wet strength agent due to this problem. The tissue made in accordance to the invention exhibits both high initial decay and high initial wet strength, which provide numerous benefits to both consumers and papermakers.

The invention is further described in the following illustrative examples in which all parts and percentages are by weight unless otherwise indicated.

Comparative Example 1

In this example, a prior art degrading agent composition including calcium hydroxide as the degrading agent in a degradation inhibiting carrier at a weight ratio of 1:4 was formulated. The initial viscosity after mixing was 780 cPs and became very viscous within 24 hours (viscosity over 10,000 cPs), which could not be pumped for delivery to the sheet.

Example 1

In this example, a degrading agent composition including calcium hydroxide, a degradation inhibiting carrier at a weight ratio of 4 parts to 1 part calcium hydroxide to carrier, and ethoxylated tridecylalcohol (TDA-3, a non-ionic surfactant) at 5% by weight of the composition was formulated. The final viscosity after 24 hours of again at room temperature 859 cPs. This example clearly demonstrates the benefit of using a non-ionic surfactant for making it possible to apply the product and obtain it's associated performance attributes.

Example 2

In this example, a degrading agent composition including calcium hydroxide, a degradation inhibiting carrier at a weight ratio of 4 parts to 1 part calcium hydroxide, and ethoxylated tridecylalcohol (non-ionic surfactant) at 9% by weight of the composition was formulated. Initial viscosity was 141 cPs and after about 24 hours was 593 cPs.

Example 3

In this example, the material from example 2 had a post addition of 2% ethoxylated tridecylalcohol (non-ionic surfactant). The viscosity was 328 cPs after 24 hours.

The results of examples 1 and 2 are summarized in Table 1. Comparative example 1 clearly demonstrates that in the absence of the non-ionic surfactant the composition was not usable due to the significant increase in viscosity. Examples 1-3 demonstrate the unexpected benefit of adding a non-ionic surfactant exemplified by ethoxylated tridecyl alcohol that resulted in a significantly reduced viscosity. The viscosity of these formulations can also be controlled by selecting an appropriate level of the non-ionic surfactant.

TABLE 1

| | Degrading Agent | Degrading Agent to Degradation Inhibiting Carrier Ratio | Non-ionic surfactant | Brookfield viscosity at 25° C. (cPs) after 24 hours |
|---|---|---|---|---|
| Comp. Ex. 1 | calcium hydroxide | 1:4 | none | >10,000 |
| 1 | calcium hydroxide | 1:4 | 5% TDA-3 | 859 |
| 2 | calcium hydroxide | 1:4 | 9% TDA-3 | 593 |
| 3 | calcium hydroxide | 1:4 | 11% TDA-3 | 328 |

Although the present invention has been described in detail with reference to certain preferred versions thereof, other variations are possible. Therefore, the spirit and scope of the appended claims should not be limited to the description of the versions contained therein.

What is claimed is:

1. A process for forming a tissue product, comprising:

applying a temporary wet strength agent to a pulp slurry, wherein the temporary wet strength agent is capable of forming hemi-acetal bonds with fibers of the pulp slurry in an amount effective to prevent immediate degradation of the tissue product upon contact with water;

applying a degrading agent composition comprising a degrading agent, a degradation inhibiting carrier comprising a lotion or a cream, and a non-ionic surfactant in an amount effective to provide a viscosity of the degrading agent composition less than 3,000 cPs at 25° C. after 24 hours of storage, wherein the non-ionic surfactant is selected from the group consisting of: fatty acid polyoxyethylene sorbitan esters, fatty acid polyoxyethylene sorbitol esters, polyoxyethylene castor oils, alkylpolyoxyethylene amines, and amides, fatty acid sorbitan esters, fatty acid polyglycerin esters, fatty acid sucrose esters, polyethers-modified silicone-base surfactants, alkylaralkylpolyether-modified silicone-base surfactants, epoxypolyether-modified silicone-base surfactants, alcohol-modified silicone-base surfactants, fluorine-modified silicone-base surfactants, amino-modified silicone-base surfactants, mercapto-modified silicone-base surfactants, epoxy-modified silicone-base surfactants, allyl-modified silicone-base surfactants, perfluoroalkylethylene oxide adduct, and a combination thereof; and forming a tissue product, wherein the temporary wet strength agent and the degrading agent are in an amount effective to make the tissue product exhibit (i) an immediate wet tensile strength of at least 90% of the wet strength as compared to a tissue product that does not contain a degrading agent and (ii) a wet soak decay that is at least a ten point improvement as compared to a tissue product that does not contain a degrading agent, wherein wet soak decay is determined as the difference between the initial wet tensile strength and a thirty minute wet soak tensile strength as a percentage of the initial wet tensile strength.

2. The process of claim 1, wherein the degrading agent is selected from the group consisting of alkaline agents, oxidizing agents, nucleophilic agents, and combinations thereof.

3. The process of claim 1, wherein the temporary wet strength agent is a glyoxylated polyacrylamide.

4. The process of claim 3, wherein the glyoxylated polyacrylamide is added at an amount of from about 0.05% to about 2.0% by dry weight of the pulp slurry.

5. The process of claim 1, wherein the degrading agent is a liquid.

6. The process of claim 1, wherein the degrading agent is a solid moiety suspended in the degradation inhibiting carrier.

7. The process of claim 1, wherein the degradation inhibiting carrier is hydrophobic.

8. The process of claim 1, wherein the degrading agent is selected from the group consisting of magnesium hydroxide, calcium hydroxide, magnesium bisulfite, magnesium oxide, zinc oxide, sodium sulfite, magnesium carbonate-magnesium hydroxide, sodium oxide-aluminum oxide, hydrogen peroxide, sodium carbonate, sodium bicarbonate, sodium benzoate, calcium carbonate, calcium bicarbonate, sodium acetate, and combinations thereof.

9. The process of claim 1, wherein the non-ionic surfactant is in an amount less than 80 weight percent of the degrading agent composition.

10. The process of claim 1, wherein the pulp slurry further contains a permanent wet strength resin in an amount that is less than 250 ppm.

11. The process of claim 1, wherein the degradation inhibiting carrier is selected from the group consisting of mixtures containing materials selected from the group consisting of water, mineral oil, petrolatum, sorbitol, stearic acid, lanolin, lanolin alcohol, cetyl alcohol, glyceryl stearate, PEG-100 stearate, triethanolamine, dimethicone, propylene glycol, microcrystalline wax, triethyl citrate, PPG-3 myristyl ether, disodium EDTA, methylparaben, ethylparaben, propylparaben, fragrance, xanthan gum, butylparaben, methyldibromo glutaronitrile, and combinations thereof; lotions containing the following materials selected from the group consisting of water, glycerin, sodium myristoyl sarcosina, PEG-120 methyl glucose dioleate, sodium lauroamphoacetate, disodium lauroamphoacetate, glycol distearate, PEG-150 pentaerithritol tetra stearate, sodium tridecethsulfate, polyquaternium-10, sodium laureth sulfate, phenoxyethanol, cocamide mea, citric acid, DADM hydantoin, disodium EDTA, laureth-10, fragrance, and combinations thereof; creams containing materials selected from the group consisting of water, sodium $C_{14-16}$ olefin sulfonate, cocamidopropyl betaine, cetyl alcohol, stearyl alcohol, di-$C_{12-15}$ alkyl fumarate, coco-glucoside, coconut alcohol, sodium methyl cocoyl taurate, DEA-cetyl phosphate, matriciaria (*chamomilla recutita*) flower extract, *aloe barbadensis* leaf extract, chamonile (*anthemis nobiiis*) flower extract, hydroxypropyl methylcellulose, potato (*solanum tuberosum*) starch, propylene glycol, fragrance, and combinations thereof; creams containing materials selected from the group consisting of water, sodium cocoyl isethionate, propylene glycol, stearic acid, cetearyl alcohol, cocoamidopropyl betaine, hydroxypropyl methylcellulose, sodium lauroyl sarcosinate, salicylic acid, menthol, fragrance, magnesium aluminum silicate, disodium EDTA, methylparaben, propylparaben, DADM hydantonin, titanium dioxide (CI77891), and combinations thereof; petroleum distillates; polyoxyethylene(10) oleyl ethers; polyoxyethylene(2) cetyl ethers; and combinations thereof.

12. The process of claim 1, wherein applying the degrading agent composition comprises mixing the composition with the pulp slurry.

13. The process of claim 1, wherein applying the degrading agent comprises applying the composition to a surface of a wet sheet.

14. The process of claim 1, wherein applying the degrading agent composition comprises applying the composition to a surface of a dry sheet.

* * * * *